US005362023A

United States Patent [19]

Reyes

[11] Patent Number: 5,362,023

[45] **Date of Patent: * Nov. 8, 1994**

[54] FOLDING BOOK SUPPORT

[76] Inventor: Christopher Reyes, 14920 Farwell Ct., Saratoga, Calif. 95070

[ * ] Notice: The portion of the term of this patent subsequent to Mar. 1, 2011 has been disclaimed.

[21] Appl. No.: 179,906

[22] Filed: Jan. 11, 1994

Related U.S. Application Data

[63] Continuation of Ser. No. 997,297, Dec. 23, 1992, Pat. No. 5,290,003.

[51] Int. Cl.[5] ..... A47B 97/04

[52] U.S. Cl. ..... 248/461; 248/447.2; 248/455; 248/903

[58] Field of Search ..... 248/461, 460, 462, 463, 248/446, 447, 447.2, 453, 454, 455, 903

[56] References Cited

U.S. PATENT DOCUMENTS

| | | | |
|---|---|---|---|
| 940,472 | 11/1909 | Oldenbusch | 248/463 |
| 963,327 | 7/1910 | Schmitt | 248/463 |
| 2,374,409 | 4/1945 | Brennan | 248/453 |
| 3,512,745 | 5/1970 | Gress | 248/453 X |
| 3,813,075 | 5/1974 | Capper | 248/461 |
| 4,978,096 | 12/1990 | Struckmann | 248/461 X |
| 5,016,852 | 5/1991 | Herendeen | 248/462 X |
| 5,192,044 | 3/1993 | Baskin | 248/309.1 |
| 5,205,526 | 4/1993 | Deutsch | 248/453 X |
| 5,290,003 | 3/1994 | Reyes | 248/461 |

*Primary Examiner*—Ramon O. Ramirez
*Attorney, Agent, or Firm*—Keith Kline

[57] ABSTRACT

A folding book support including a main support member having an attachment jaw which flexes to allow it to be affixed to the edge of a flat surface such as a table or desk. A pivoting cross-member is provided to extend the support diameter of the device. The cross-member is folded to a position colinear with the main support member for storage and transport. An optional support leg is provided for use when the edge of a suitable flat surface is not available to affix the holder.

4 Claims, 5 Drawing Sheets

FOLDING BOOK SUPPORT

This application is a continuation of U.S. application Ser. No. 07/997,297, filed Dec. 23, 1992, now U.S. Pat. No. 5,290,003.

FIELD OF THE INVENTION

The present invention relates generally to book supports, and more particularly to a device which holds a book in reading position and which can be folded to a compact size for easy storage and transport.

BACKGROUND OF THE INVENTION

Readers often have a need for a device which will support a book that the user is reading without requiring the use of the reader's hands. This is particulary true in the case of students.

Students often need to take notes while reading, and it is thus an inconvenience to have to hold the book upright. Moreover, students are often put in a position where they are required to read with a limited amount of surface space available, such as at a classroom desk, or in a crowded library.

The prior art has many examples of devices which have been created to aid users in holding their books upright. However, the devices found in the prior art are somewhat bulky and/or complex, and are therefore not easy to store and transport.

SUMMARY OF THE INVENTION

Accordingly, it is an object of the present invention to provide a book support which is very compact and easy to store and transport.

It is a further object of the present invention to simplify the manufacturing process of the book support so that the device is inexpensive.

It is a still further object of the present invention to provide a book support that is versatile and easy to use.

The present invention is a folding book support. The main support member has an attachment jaw which flexes to allow it to be affixed to the edge of a flat surface such as a table or desk. A pivoting cross-member is provided to extend the support diameter of the device. The cross-member is folded to a position colinear with the main support member for storage and transport. An optional support leg is provided for use when the edge of a suitable flat surface is not available for affixing the holder.

An advantage of the present invention is that it folds into a shape and size that may be easily stored and carried in a bookbag or other small carrying device.

Another advantage of the present invention is that it is easy and inexpensive to manufacture. In addition, recycled materials may be used if desired.

A further advantage of the present invention is that it may be adapted to be used in almost any environment in which the user wishes to read.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
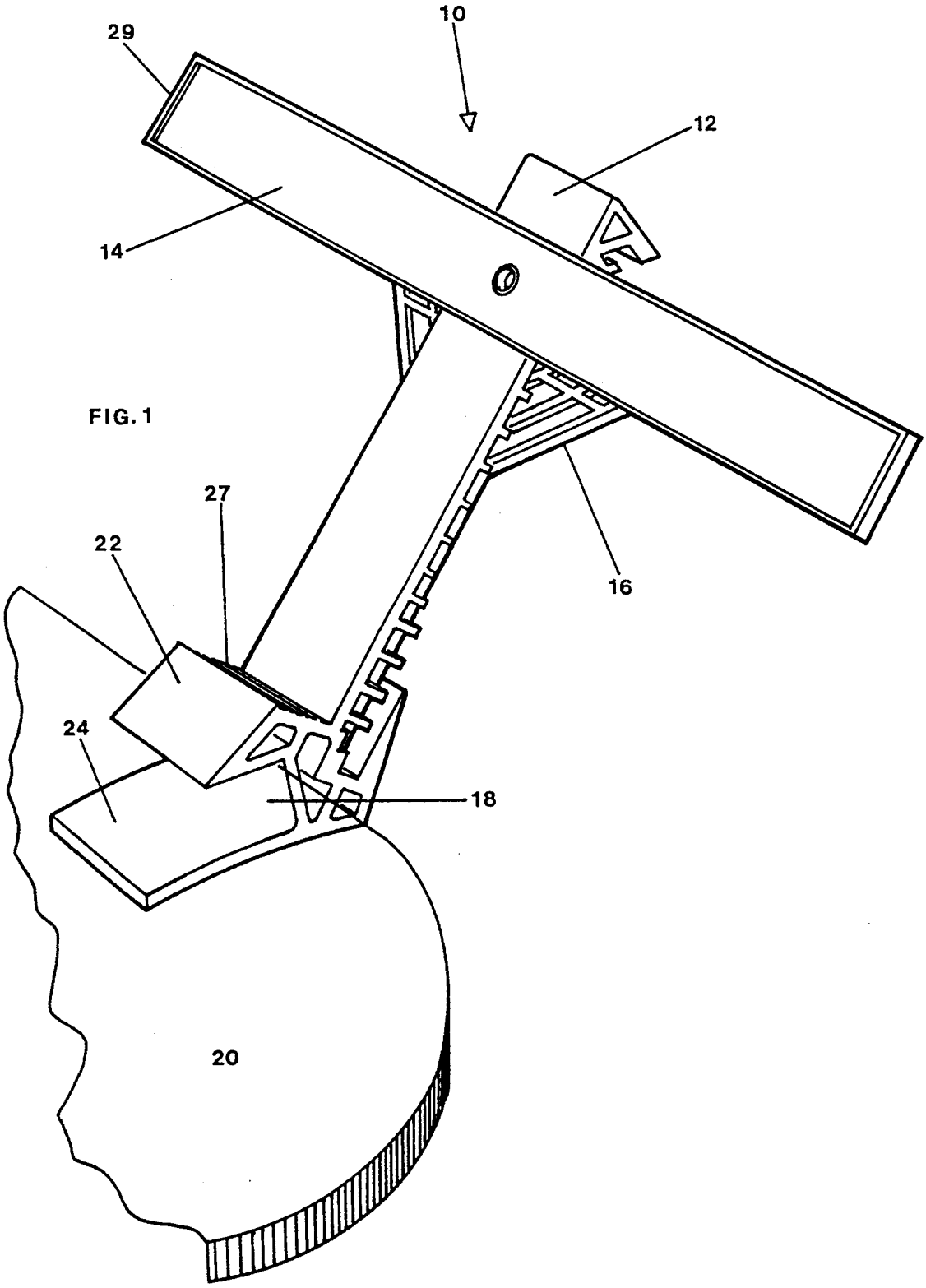
FIG. 1 is a perspective view of the folding book support of the present invention attached to the edge of a flat surface.

The present invention is a folding book support 10. The main components of the book support 10 are a main support member 12, a pivoting cross-member 14, and an optional support leg 16. The book support 10 will generally be used as illustrated in FIG.1.

In this mode, a flexible jaw structure 18 integral to the main support member 12 grips the edge of a table or desk 20. The jaw 18 includes a rigid upper gripping member 22 and a more flexible lower gripping member 24. The lower jaw member 24 is not exactly parallel to the upper jaw member 22. The lower jaw member 24 angles slightly toward the upper jaw member 22 in order to more tightly grip the surface to which the book support 10 is being attached, and to accommodate surfaces having different widths.

Figure 5:
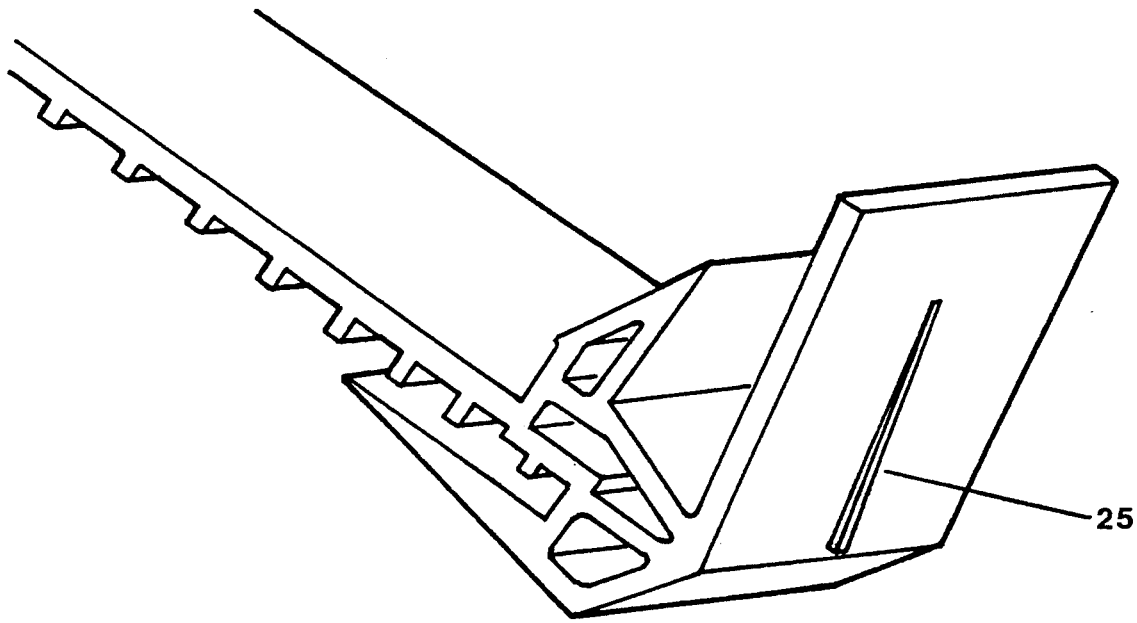
FIG. 5 is a view of the lower surface of the jaw structure.

A wedge-shaped reinforcing element 25 (see FIG. 5) is integral to the lower surface of the lower jaw member 24. The reinforcing element provides additional strength to the jaw structure 18, while allowing the lower Jaw member 24 to remain flexible.

While the book support 10 is in use as in FIG. 1, the cross-member 14 is pivoted to a position perpendicular to the main support member 12. A corrugated base 27 is included in the main support member 12 to hold the book firmly in place. A raised perimeter 29 on the cross-member 14 provides a protected surface, the remainder of the face of the cross-member 14, as a convenient surface for advertisers' and/or manufacturers' logos.

Figure 2:
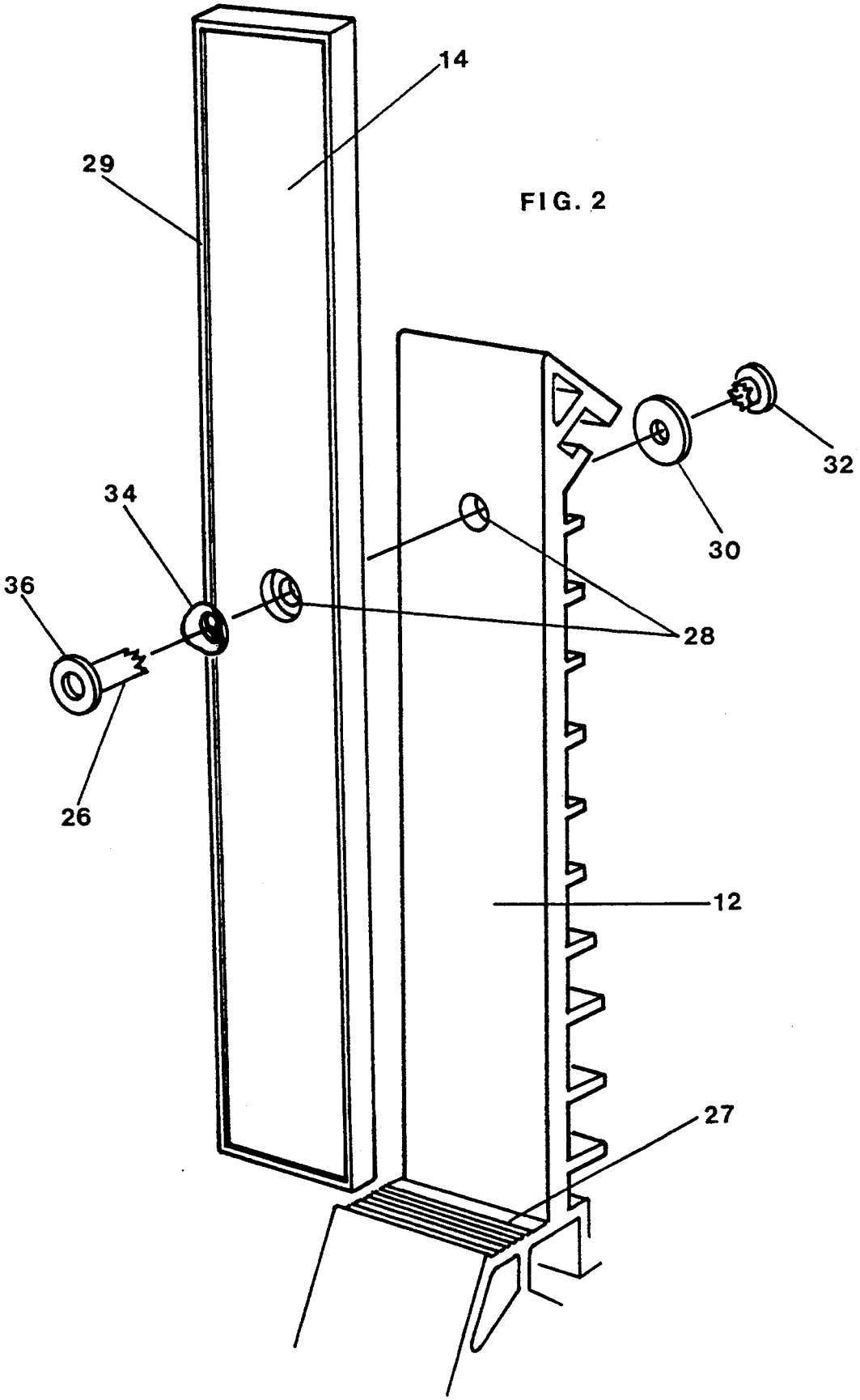
FIG. 2 is an exploded view of the attachment mechanism of the cross-member to the main support member.

The pivotable attachment of the cross-member 14 to the main support member 12 is accomplished as illustrated in FIG. 2. A rivet 26 passes through coincident apertures 28 in the members 12 & 14. A flat washer 30 installed at a base 32 of the rivet 26 minimizes wear in the material of the main support member 12. A curved spring washer 34 installed between a rivet head 36 and the cross-member 14 acts as a spring loading device to maintain tension in the rivet assembly. Thus even as some wear in the materials of the members 12 & 14 is experienced, the attachment remains stable, until the limits of the curved spring washer 34 are exceeded.

Figure 3:
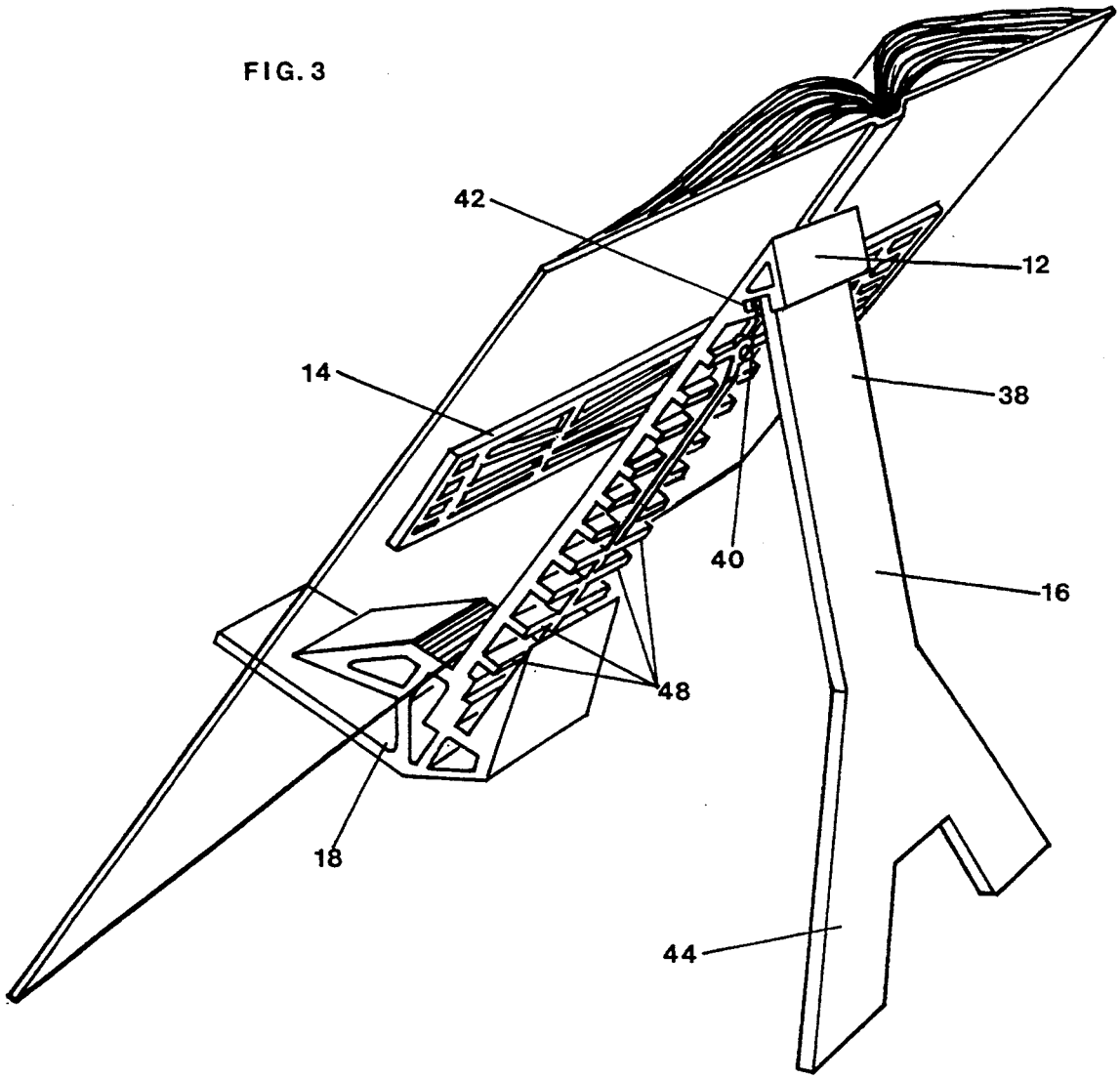
FIG. 3 is a perspective view of the present invention with the optional support leg employed.

When the optional support leg 16 is employed, the book support 10 functions as shown in FIG. 3. A first end 38 of the support leg 16 includes an integral raised edge 40 which extends the width of the support leg 16. The raised edge 40 is designed to fit into a receiving notch 42 in the main support member 12. This mechanism ensures that the installation of the support leg 16 into the main support member 12 is secure. When installed, the support leg 16 is fixed at an approximately 60° angle to the main support member 12.

A second end 44 of the support leg 16 spreads into an inverted Y-shape to ensure maximum stability of the book support 10 when the user is not able to take advantage of the jaw attachment means, and the device is being used as shown in FIG. 3.

Figure 4:
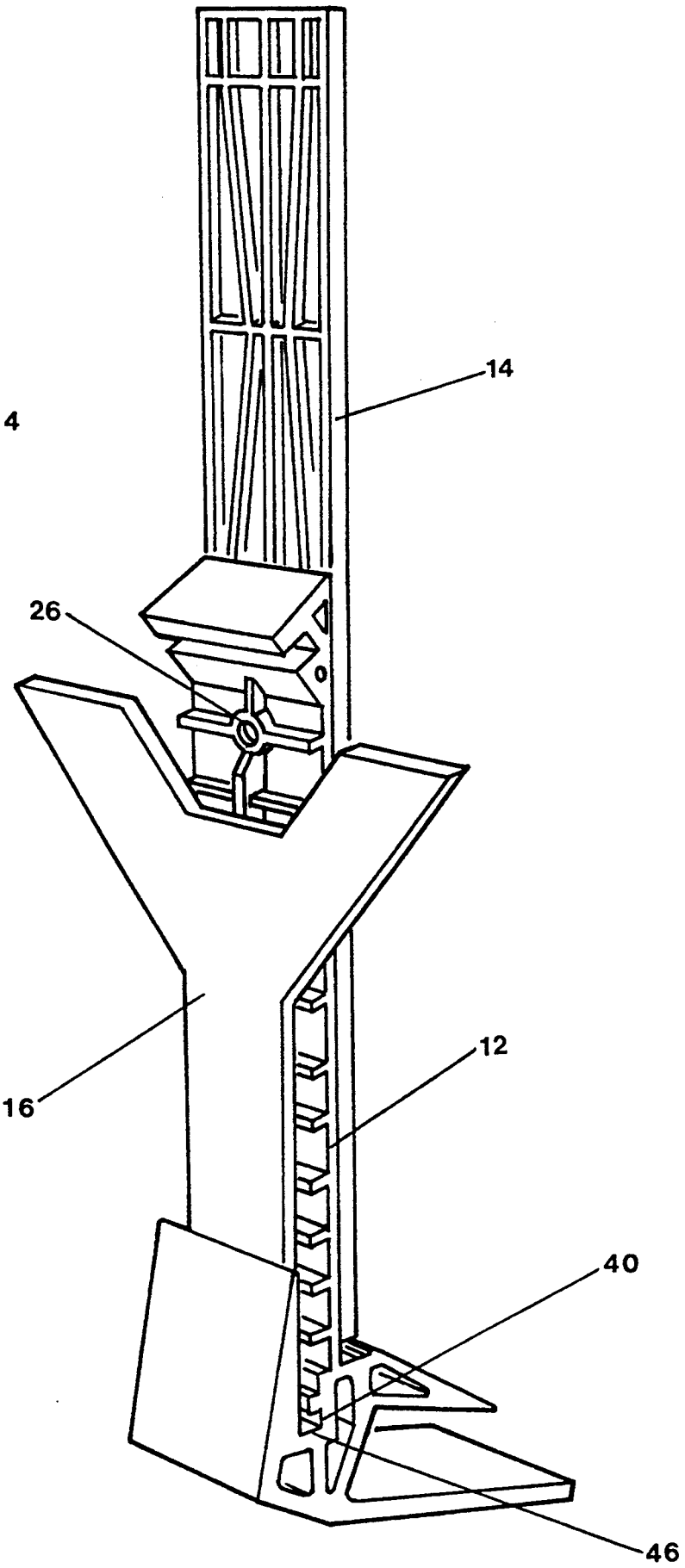
FIG. 4 is a perspective view of the present invention in its disassembled and contracted state.

One of the chief advantages of the present invention is that it folds into a very compact conformation for storage and transportation. This conformation is shown in FIG. 4. The cross-member 14 is pivoted so that it is parallel to the main support member 12. The support leg 16 is removed from the receiving notch 42, inverted, and stored in a storage recess 46 at the rear of the jaw structure 18. Note that the support leg 16 remains in this position, without interfering with the function of the book support 10 in any way, when the device is utilized with the jaw 18 attachment as shown in FIG. 1.

While there are many materials that could be utilized to manufacture the present invention, it is envisioned that the book support 10 will be constructed of plastic. To give added strength to the main support member 12, a series of ribs 48 are added to its backside. (See FIG. 3.) These ribs are conveniently spaced so that a user fumbling in a bookbag can readily grasp the support. This spacing also aids the user during installation of the device.

The front surfaces of both the cross-member 14 and the support leg 16 are solid, but in order to reduce the overall weight of the device, the rear of these elements include mostly open space with ribbing to increase strength. This construction also reduces manufacturing costs.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A device to support a book comprising:

a main support member and a cross-member pivotally attached to the main support member; wherein the cross-member pivots to a position parallel to the support member for storage when the support is not in use, and pivots to a position perpendicular to the support member when supporting a book in a position of convenience for a reader, and the cross-member further includes a flat, smooth area to display advertising material; and the main support member includes an integral, one-piece, flexible jaw structure enabling the device to be attached to a desk or table, and further includes a base upon which the book rests; and wherein the relative positions of the main support member and the cross-member are maintained by tensioning means at the point of attachment of the main support member and the cross-member.

2. The device of claim 1 wherein:

the base of the main support member is corrugated to ensure that the book remains in place.

3. The device of claim 1 wherein:

the tensioning means is a curved spring washer.

4. The device of claim 1 wherein:

an additional support leg is provided which includes a raised edge that fits securely into a receiving notch in the main support member, thus locking the support leg in position.

* * * * *